United States Patent [19]

Guth et al.

[11] 4,166,830

[45] Sep. 4, 1979

[54] DIACRITIC CRACKING OF HYDROCARBON FEEDS FOR SELECTIVE PRODUCTION OF ETHYLENE AND SYNTHESIS GAS

[76] Inventors: Eugene D. Guth, 18711 Valley Dr., Villa Park, Calif. 92667; LeGrand A. Daly, 6616 Via Siena; John K. Arand, 5731 Mistridge Dr., both of Rancho Palos Verdes, Calif. 90274

[21] Appl. No.: 917,462

[22] Filed: Jun. 21, 1978

[51] Int. Cl.[2] ..... C07C 3/08

[52] U.S. Cl. ..... 252/373; 208/129; 585/256; 585/259; 585/413; 585/539; 585/615; 585/648; 585/650; 585/752; 585/950; 585/953

[58] Field of Search ..... 260/683 R; 208/129

[56] References Cited

U.S. PATENT DOCUMENTS

| | | | |
|---|---|---|---|
| 2,767,233 | 10/1956 | Mullen et al. | 260/683 R |
| 2,985,698 | 5/1961 | Pechtold et al. | 260/683 R |
| 3,178,488 | 4/1965 | Akin | 260/683 R |
| 3,795,713 | 3/1974 | Washimi et al. | 260/683 R |
| 3,843,744 | 10/1974 | Kramer et al. | 260/683 R |
| 3,959,401 | 5/1976 | Albright et al. | 260/683 R |
| 4,065,379 | 12/1977 | Soonawala et al. | 260/683 R |

*Primary Examiner*—C. Davis

[57] ABSTRACT

A continuous process for the selective production of ethylene by the diacritic cracking of heavy hydrocarbon feeds such as residual oils, heavy vacuum gas oils, atmospheric gas oils, crude oils and coal-derived liquids. The diacritic cracking takes place in a non-tubular multi-zone reactor at elevated pressures (e.g. 70–1000 p.s.i.a.) A fuel is combusted with oxygen in the first section of the multi-zone reactor. The high temperature products of combustion of the first zone pass into a second section of the reactor where the feed is atomized and cracked to yield products including ethylene, acetylene and synthesis gas. The reaction products of the second zone then pass into a third section in which they are quenched. In each stage of the reactor the present process seeks to prevent the build-up of coke deposits on the walls of the reactor. In the first two stages, a film of gas such as $CO_2$ or $N_2$ is injected along the inner walls to prevent build-up of coke. In the quench section, the liquid material introduced as the quenching fluid also acts as a barrier to prevent coking.

56 Claims, 2 Drawing Figures

DIACRITIC CRACKING OF HYDROCARBON FEEDS FOR SELECTIVE PRODUCTION OF ETHYLENE AND SYNTHESIS GAS

BACKGROUND OF THE INVENTION

1. Field of the Invention

The present invention relates generally to improvements in a commercial process for non-tubular cracking of heavy hydrocarbon feeds for the purposes of producing ethylene and other valuable olefin products as well as chemical grade synthesis gas.

2. Prior Art

A great deal of prior work has been done in connection with the cracking of hydrocarbon feed stocks to obtain basic chemicals such as ethylene, acetylene and propylene. Presently, the most common approach involves the cracking of a hydrocarbon feed in the presence of steam in a fired tubular furnace. In such a steam cracking process the thermal energy of the combustion gases is transferred to the feed through the metal walls of the tubes and therefore the tube metallurgy becomes one of the limiting factors with respect to the maximum cracking temperature which is usually several hundred degrees below that which can be achieved in a non-tubular cracking process such as the diacritic cracking process described herein. To obtain proper cracking conditions, the residence time in a steam cracker must be substantially longer to compensate for the lower temperatures. For example, residence time of about 0.25 to 0.50 seconds is typical in many modern steam cracker designs. Such longer residence times lead to a furnace effluent hydrocarbon composition that is significantly different from that obtained from a process utilizing a non-tubular reactor. For example, acetylene and ethylene yields are generally lower but the yields of propylene, $C_4$ olifins and pyrolysis gasoline are usually somewhat higher.

In view of the shortcomings of steam cracking, considerable work has been done in connection with the thermal cracking of hydrocarbons to obtain higher yields of ethylene or in some instances, acetylene. For example, U.S. Pat. No. 2,790,838 deals with the general process of a single pass cracking method for the production of mixtures of acetylene and ethylene (with the primary emphasis on acetylene) in which a hydrocarbon feed stock is cracked by "thermal shock" when contacted with hot gases produced by the combustion of a fuel. This patent does not teach a process operating at elevated pressures and does not discuss the elimination of coking problems which result in such a process, especially when having hydrocarbon feed stocks are used, such as residual oils, crude oils, vacuum gas oils atmospheric gas oils and coal derived liquids.

Other prior art patents are known which deal with thermal cracking of certain hydrocarbons. U.S. Pat. No. 3,320,154 discusses the use of combustion gases which are mixed with naphtha and steam at elevated pressure (about 90 psia). The cracked gases are adiabatically expanded in a turbine to drive the turbine while rapidly cooling the gas. The latter patent teaches the use of naphtha and does not deal with heavy feeds since it is believed that heavy unreacted feeds and resulting products would foul the turbine.

U.S. Pat. No. 2,751,334 involves a process to vaporize hydrocarbons and produce coke from a hydrocarbon feed. Some olefins are produced but in relatively low yields. A feed is sprayed into a vortex of hot gases. The hot gases may be preheated by air or an oxygen containing gas which combusts part of the feed. Pressure is employed in the reaction zone but is not considered critical since both atmospheric subatmospheric or super-atmospheric pressures can be used. The preferred pressure is atmospheric pressure or slightly elevated pressure such as 5 to 30 psia. The overall emphasis of the invention was the production of a vaporous hydrocarbon fraction and a particulate coke fraction.

U.S. Pat. No. 2,912,475 teaches a process in which ethylene and acetylene are manufactured by contacting a hydrocarbon with a carrier gas consisting of a hot combustion gas and a secondary gas. The secondary gas has the same chemical nature as the combustion gas but contains hydrogen and functions to remove the oxygen molecules and atoms from the combined gas stream before pyrolysis. The latter process appears to be a somewhat more complicated version of a steam cracking process.

U.S. Pat. No. 3,959,401 relates to a reactor design for cracking hydrocarbons by mixing with hot gases. Tangential feed flow is used in the reactore. The hot gases may be steam or combustion products. The reactor of the latter patent does not deal with the prevention of coking or the utilization of gas filming or any other technique to minimize coking of the reactor.

U.S. Pat. No. 3,178,488 describes a process for thermally cracking a low boiling paraffinic hydrocarbons in a flame cracking process. The linear velocity of the hydrocarbon feed must be controlled (e.g., 50 to 250 feet per second) in a 7 to 11 inch diameter Venturi throat. The process involves two cracking zones which are formed within a reaction zone. One is an interior cracking zone and the other an exterior cracking zone which is generally annular in relation to the interior zone. The interior zone is characterized by a high velocity gas, high temperature and thorough mixing of the combustion gases with the hydrocarbon cracking feed. The exterior cracking zone is characterized by lower velocity, lower temperature and by the fact that the hydrocarbon feed is not so thoroughly mixed with the combustion gases. This process results in the simultaneous production in the entire reaction zone of acetylene, ethylene and propylene. Also, one of the main aspects of the latter process is the incomplete or non-uniform mixing of the reacted hydrocarbon feed with the hot combustion gases in the Venturi section and in the reaction completion zone.

U.S. Pat. No. 2,823,243 involves a process in which hydrogen and oxygen are burned and mixed with a gaseous hydrocarbon stream. The flow velocity is increased, then decreased, then increased after quenching and an abrupt change in direction. A helically moving blanket of tempering gas is disposed about the combustion gas to cool the combustion gas from about 4500° F. to 5300° F. to not higher than 4200° F. No mention is made of elevated pressure and only gaseous hydrocarbons are treated.

Some prior art patents dealing with the thermal cracking of feeds require very high velocities (e.g. sonic or near sonic velocities) in the cracking reactor. For example, U.S. Pat. No. 2,767,233 discloses a process in which combustion gases are mixed with an aliphatic hydrocarbon feed. High velocities of at least 1,000 feet per second are taught. Also, U.S. Pat. No. 3,408,417 involves the use of sonic velocities in the feed injector and in the reactor. The diacritic cracking of the present process is achieved with substantially lower velocities in the cracking reactor stage (e.g. 250–350 feet per second) and at elevated pressure of about 70 psia to 1,000 psia. The control of the present cracking process is easier and the cracking is more selective.

In addition to the above-mentioned patents, the Applicants are also aware of other patents which deal generally with processes or apparatus which involve thermal cracking of hydrocarbon streams or related technology for obtaining acetylene, ethylene or other olefin type products. The patents of which Applicants are aware include U.S. Pat. Nos. 2,985,698, 2,934,410; 3,301,914; and 3,579,601. Applicant is also aware of U.S. Pat. No. 4,035,137 which deals with a fuel burner for the combustion of liquid and gaseous fuel which has been designed to minimize the levels of nitric oxides produced. The fuel burner of the latter mentioned patent also includes inlet orifices for introducing a stream of air into the burner for purposes of preventing coking.

In addition to the above-mentioned patents, the Applicants are also aware of certain experimental work which has been conducted in connection with a process for the thermal cracking of a hydrocarbon (i.e., hexane) into ethylene, acetylene and other by-products such as propylene and butadiene. Such process was of an experimental nature to determine yields and feasibility, and therefore involved only short-term testing which did not consider the prevention of coking, which is a severe practical problem in commercial installations. There were no "decoking" techniques or steps in the combustor, reactor or heat exchange sections of such experimental process. Also, the experimental process used hexane as a feed stock and accordingly the process and related equipment were not designed to handle and inject heavier and more troublesme hydrocarbon feed stocks such as those of the present invention.

None of the prior art processes, which Applicants are aware of, present a practical and economical process for producing high yields of ethylene (along with other valuable olefin products and synthesis gase) by the diacritic cracking of heavy hydrocarbon feed stocks (e.g., residual oils, crudes, coal liquids, etc.) at elevated pressures (i.e., about 70 psia to 1,000 psia) in such a way that the reactor and subsequent heat exchange equipment will not be adversely affected by severe coking. The main advantages of the invented process over that of the known prior art will be apparent from the detailed description of the invented process described hereinafter.

Until quite recently, there has not been much emphasis on the use of hard to handle fuels, such as resids and crudes. The economics were such that feed stocks such as naphtha were readily available and inexpensive. With diminishing supplies and higher proces for lighter and easier to handle feeds, it is desirable to use the heavy hydrocarbon feed stocks which are not in great demand and which are considerably less expensive. The present process allows for the economical use of such heavier feed stocks by selective diacritic cracking which optimizes the ethylene yield, produces valuable chemical grade synthesis gas and also eliminates the coking problems which in the past have severly restricted the use of resids, crudes and other heavier feedstocks in continuous thermal cracking processes. Conventional steam cracking processes have been generally confined to lighter hydrocarbon feeds such as naphtha.

SUMMARY OF THE INVENTION

Ethylene is the largest volume petrochemical feed stock in the United States and in many other industrial countries. Ethylene is used in a broad range of widely used plastics and industrial chemicals. Low and high density polyethylene resin demand alone presently accounts for over 40 percent of the total demand. LEthylene oxide, styrene and vinyl chloride monomer are other significant end-uses for ethylene. Ethanol, acetaldehyde, linear higher alcohols, linear alpha-olefins, vinyl acetate monomer, ethyl chloride, chlorinated solvent derivatives of ethylene dichloride and numerous smaller volume derivatives likewise consume ethylene in significant quantity. Therefore, the demand for ethylene is great. Chemical grade synthesis gas (CO and $H_2$) is also an extremely valuable product. Synthesis gas is used to produce products such as methanol, synthetic natural gas and gasoline.

The present process involves non-tubular hydrocarbon cracking of heavy hydrocarbon feed stocks (such as residual oils, crude oils, vacuum gas oils, atmospheric gas oils and coal derived liquids) for the production of high yields of light olefins and by-products. The coal derived liquids referred to herein are hydrocarbons produced by coking or hydrogenating coal and then separating and condensing the liquids produced thereby. The process is preferably carried out by means of a generally cylindrical muti-zone reactor in which a hydrocarbon fuel is oxidized with oxygen in a combustion section. The hot combustion gases pass into a reaction zone where a heavy hydrocarbon feed stock is injected by atomization into the hot combustion gases under highly controlled conditions, causing diacritic cracking to occur. The product gases produced in the reaction zone are then sent into a third section of the multi-zone reactor where a liquid film quench rapidly cools the product gases. The feed stocks are injected by atomization into the reactor zone is such a manner that impingement of the feed stock on the walls of the reactor is minimized but intimate contact between the hot combustion gases and the feed stock is maximized. It has been found that the feed stock should preferably be preheated and atomized with steam or other gaseous streams under pressure to produce droplets of between 40 and 100 microns in diameter. The walls of the combustion section of the multi-zone reactor are preferably water cooled. It has been found that an adiabatic combustion chamber, unless water cooled, will suffer damage from high wall temperatures or thermal gradients which will greatly reduce the life of the combustion section. The present process utilizes stoichiometric adiabatic burner requirements. While some types of stoichiometric burners, such as those found in gas turbine primary zones have an excess of air to absorb the heat generated in the combustion processes, a totally stoichiometric adiabatic burner of the type used in the present process does not. Therefore, the heat generated in the combustion processes could lead to overheating of the walls unless provisions for external cooling in the combustion section were made. The gas glow patterns must be established to minimize recirculation effects. In the combustion chamber no swirl is used. It has been found that simple impinging jet flow patterns are more predictable than swirling flow and therefore, it is easier to develop and control such patterns as is necessary. The injection is provided by a number of spray nozzles located around the periphery of the combustion chamber for radical injection.

The fuels used in the combustion section can be any readily available and economically feasible fuel. It has been found that the invented process can be economically run with diesel oil No. 2 or a suitable residual oil which can be added as necessary for the make-up fuel in combination with the fuel oil and other heavy hydrocarbons produced in the recovery section of the present process. It has been found that No. 2 diesel oil is a suitable, practical and economical combustion fuel.

One of the chief problems in connection with the production of ethylene by thermal cracking has been obtaining proper reaction conditions to make the process highly selective for the purpose of forming high yields of ethylene. The inventors have found that this can be accomplished by a chemical reaction which they define as "diacritic cracking" in order to distinguish such reaction from normal adiabatic cracking. The present invention contemplates controlling the reactions to favor the forward reaction to crack and form ethylene while repressing the back reaction, polymerization, and the further decomposition of ethylene to acetylene. The theory in connection with the diacritic cracking process will be discussed in further detail in the description of the preferred embodiments of the present invention. It has been found that for the heavy feed stocks contemplated, a reactor residence time of three to five milliseconds is all that is normally required prior to the introduction of a quench fluid in order to obtain the proper degree of diacritic cracking favoring the production of ethylene. The atomization and injection of the feed into the reactor must be controlled to insure good mixing of the feed by providing maximum spray coverage and maximum penetration of the combustion gas stream. The reaction chamber should be sized to have a reference velocity of approximately 250 to 350 feet per second. The latter velocities are considerably different from many prior processes which have used sonic type nozzles in the reactor at the point of feed injection. It has been found that better control of the mixing and cracking residence time can be obtained at lower velocities utilizing atomized fuel particles having a size of approximately 40 to 100 microns in their largest dimension and allowing such particles to be sprayed into the stream in such a manner (i.e., about 60% - 70% across the diameter of the reactor section) that there is no impingement of the feed on the opposing walls of the reactor. However, the angle of injection must be determined for each feed to give maximum spray coverage and maximum penetration into the combustion gas stream. Also, it has been found, as with the combustion section, that no swirl of the feed during injection is desired since such swirl could result in less controllable flow patterns and possible recirculation problems. Recirculation will cause the ethylene yield to suffer since additional cracking to acetylene will take place.

From a commercial and economic standpoint it is important to try to eliminate coking throughout the entire process. In the reactor section, coking can be minimized somewhat by the design of the wall construction and the gas velocities used. However, to insure that coking will not occur, a gas film of an inert gas, such as $CO_2$ or $N_2$, is introduced along the walls just down stream of the feed injectors to prevent possible coking. Also, an inert gas, such as $CO_2$ or $N_2$, can also be used to shroud the injector nozzles as well. The gas film stream can be introduced into the reactor with or without a swirl component. The flow conditions throughout the reaction chamber of the zone reactor must be carefully controlled so that there is little chance of any recirculation back upstream. Thus, the mixing and the reaction must be well defined and well controlled. The flow conditions which are necessary to prevent such recirculation are often referred to as "plug flow" conditions.

The products of the diacritic cracking then pass into the quench zone of the multi-zone reactor in which the mixed gaseous product temperature is reduced substantially and rapidly from about 2400° F. to 2500° F. to about 1600° F. to precisely control the reaction time of the cracking and to prevent further cracking and other undesirable reactions (e.g. polymerization) from occurring. A liquid hydrocarbon quench is preferred. Such hydrocarbon fluid is injected by spraying into the quench section of the reactor to provide a highly efficient temperature transfer medium. The nozzles for such quenching step are standard commercially available spray nozzles. The flow conditions through the quench chamber must also be carefully controlled to prevent recirculation, and therefore plug flow conditions must be maintained in the quench section as well as through the reactor section previously discussed.

After the product gases leave the quench section of the multi-zone reactor, they preferably pass through a primary heat exchanger. It is at this point in the process that coking presents the greatest problem, especially when heavy feed stocks, such as resids, crudes and vacuum gas oils, are used. In the preferred process, the first-stage heat exchanger is a simple tube and shell exchangers where the product gases are cooled to about 900° F., then passed on to quench oil cooler stages and then to a second stage heat exchanger where the temperature of the product gases would be cooled to approximately 300° F. to 500° F. and processed to recover ethylene and other valuable by-products.

The first-stage heat exchanger preferably has a heat shield which protrudes into each cooling tube. Under this shield is another shield which acts as a flow directional guide to feed recycled inert gases, such as $CO_2$ or $N_2$, along the walls of each tube. The flow of such inert gas can be introduced with a swirl component. The gas filming in the heat exchanger minimizes direct contact between the condensing fraction of the gaseous coked products and the walls of the heat exchanger. The gas film is introduced through a plurality of slots at spaced intervals along the heat exchanger tubes. The products then pass into conventional quench oil coolers which drop the temperature of the product gases further prior to the second stage heat exchanger. The second stage heat exchanger is a conventional high efficiency plate and fin type heat exchanger. The first stage heat exchanger, the quench oil cooler and the second stage heat exchanger are all operated at the same elevated pressure as the multi-zone reactor, thus providing a substantially smaller overall system than if an atmospheric pressure system were used. The multi-zone reactor and cooler stages are operated at elevated pressures of about 70 psia to 1,000 psia (preferably at about 80 psia to 600 psia) to allow for better yields of ethylene and to eliminate greater compression costs in the downstream section where the product recovery is made.

After the product stream leaves the second stage heat exchanger, it is then processed using conventional processes similar to other thermal cracking processes in which ethylene, acetylene and other olefin products are recovered. For example, the product stream is passed to a main fractionator and a gasoline-fuel oil splitter to obtain additional fuel oil which can be recycled to the combustor, acid gases ($CO_2$ and $H_2S$) are removed, the gas is compressed and then sent either to a lean oil absorption unit (for a refrigeration recovery processor) to remove $H_2$, CO, $N_2$ and chemical grade synthesis gas and then the product stream is sent to the standard recovery section in which the ethylene is obtained as well as a number of other valuable by-products such as acetylene (if desired) propylene, butadiene, benzene, toluene, xylene and heavy liquid hydrocarbons which can be recycled through the combustor to be used as part of the fuel make-up.

The present invention utilizes heavy hydrocarbon feeds which do not have the same general utility and wide scope of commercial applications that the petroleum distillates and other lighter hydrocarbon feedstocks used by the prior art. Therefore, the present process presents significant economic benefits and incentives. While the present process can be operated effectively with lighter hydrocarbon feedstocks, the main advantage to the process over the prior art processes is the ability to use heavier hydrocarbon feed stocks which are less expensive and not in great demand.

DESCRIPTION OF THE PREFERRED PROCESS

Figure 1A:
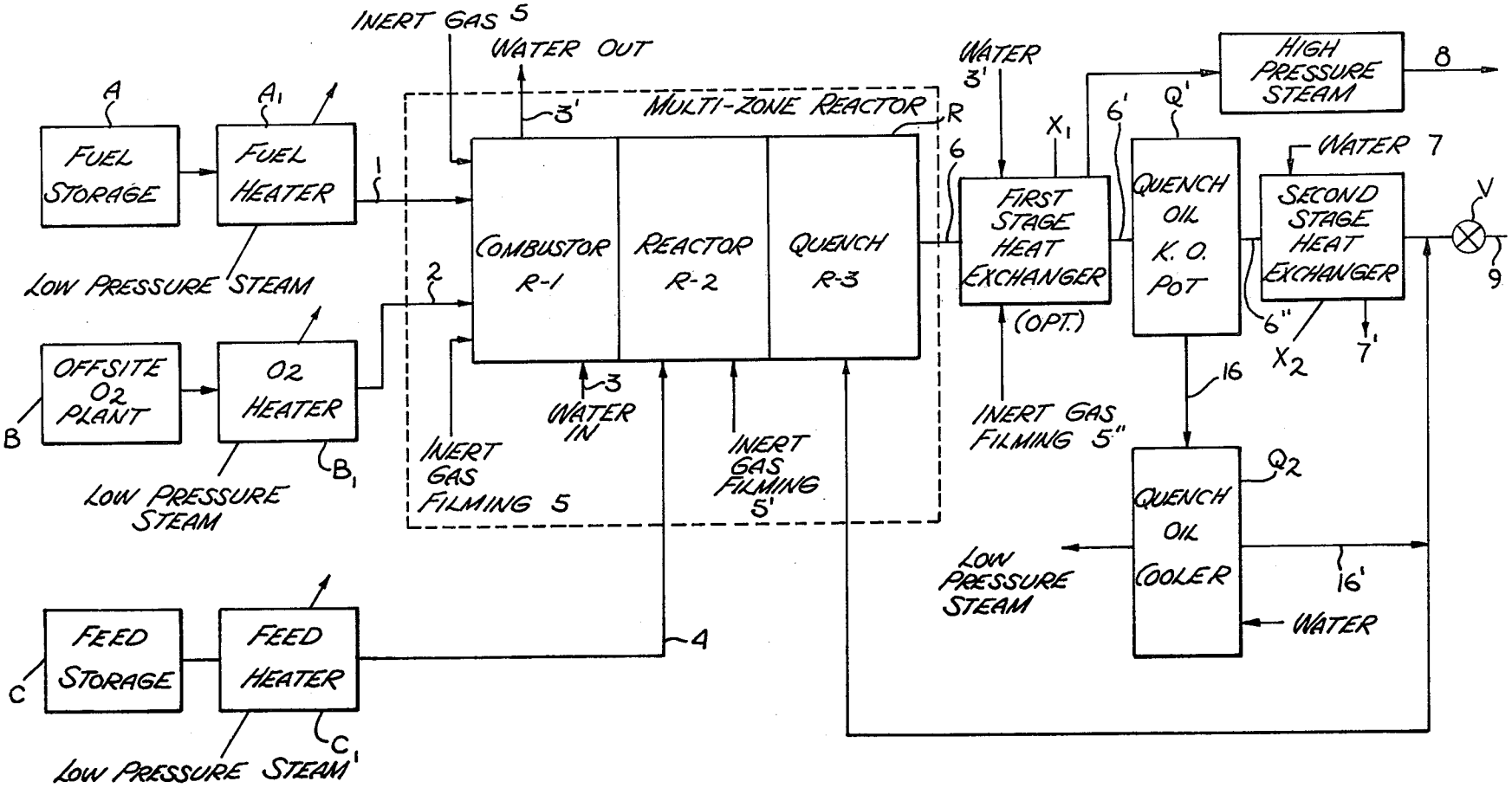
FIG. 1*a* is a schematic block diagram of the invented diacritic cracking process.
Figure 1B:
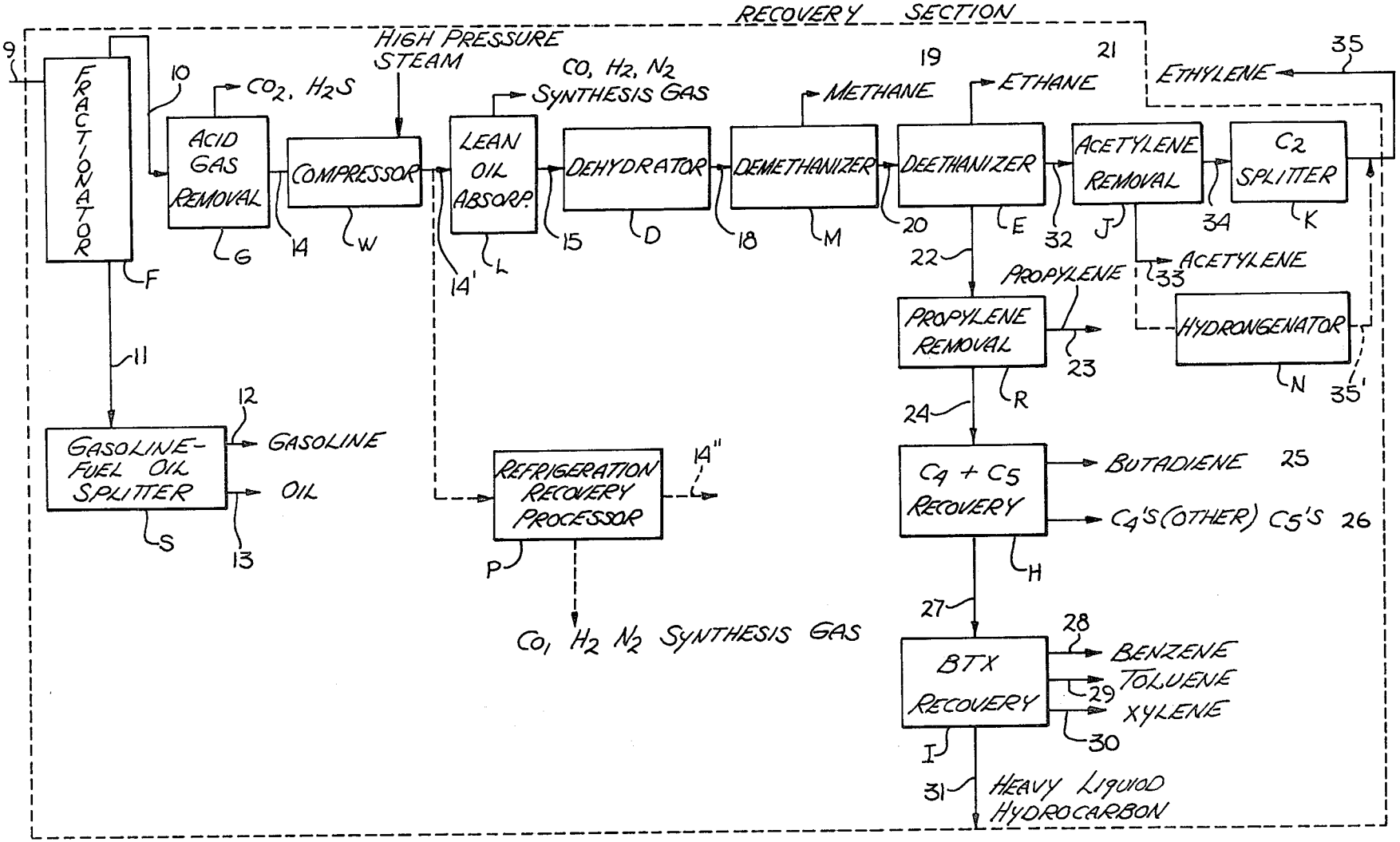
FIG. 1*b* is a schematic block diagram showing an exemplary product recovery technique after the diacritic cracking has been achieved including the recovery of ethylene, synethesis gas and high value olefin products.

The preferred process for carrying out the invented diacritic cracking method will now be described with reference to the drawings, FIGS. 1*a* and 1*b*. The process begins by providing a fuel which is fed into the multi-zone reactor for oxidation or combustion with oxygen. Therefore, a suitable fuel such as diesel fuel or residual oil is fed from a storage container A through a fuel heater $A_1$ which is heated by low pressure steam (e.g., 125 psia steam) which is generated in the heat exchanger and quench stages of the process.

If the diesel fuel such as No. 2 diesel is used, the temperature of the fuel stream 1 entering into the combustor section R-1 of the multi-zone reactor R is about 300° F. If a long residual oil is used as the primary fuel, the desired temperature of the fuel stream 1 leaving the fuel heater $A_1$ should be approximately 500° F. to 600° F. It should be understood that the present process uses as part of the fuel requirements the heavy liquid hydrocarbon oils and fuel oils which are produced in the recovery stages of the process and recycled to the fuel storage tank A. However, additional diesel fuel, residual oil or mixtures thereof can be added to the make-up fuel, as required, to augment the fuels being recovered and recycled by the downstream processing of the reaction products. Also being fed into the combustor section R-1 is a stream of oxygen 2 which has been supplied from an off-site $O_2$ plant B and heated by low pressure steam prior to entering the combustor. Preferably, the temperature of the $O_2$ stream leaving the heater $B_1$ should be approximately 200° F. to 300° F. The fuel is oxidized in the combustor R-1 to product heat, carbon monoxide, carbon dioxide and water vapor.

The combustor R-1 is an adiabatic combustion chamber which is water cooled in order to prevent damage from high wall temperatures or thermal gradients which will greatly reduce the life of such chamber. The mixture is combusted by means of an ignitor system which uses a high voltage spark to ignite the fuel-$O_2$ mixture. The ignitor system operates long enough to achieve ignition of the combustor, at which time it is shut off except for a low rate of oxygen which will act as a coolant for the ignitor parts during normal operation.

Cooling water 3 flows around the combustor section in a counter-flow direction to the combustion gases and preferably makes a helical path around the combustion chamber R-1 as it flows toward the head of the combustor. The water flow rate is controlled so that the exit temperature of water stream 3' is less than about 200° F. The cooling water 3 is brought into the multi-zone reactor R at a point close to the feed injectors located in section R-2 of the multi-zone reactor in order to also provide cooling of the feed injectors as well.

The water stream 3' which exits from the reactor is preferably used as the cooling medium in heat exchangers $X_1$ and $X_2$. All metal parts of the combustor R-1 are made from high corrosion-resistant steel. For example, all metal parts should preferably be made of type 316 stainless steel.

The operation of the combustor R-1 is steady state so as to optimize the flow conditions through the reactor. The $O_2$ to fuel ratio (by weight) should be between 2 and 3 (preferably about 2.5). As previously discussed, the fuel used in the combustor R-1 is No. 2 diesel oil or a suitable residual oil plus the recycled fractions of fuel oils and heavy condensed hydrocarbons which are added. The temperatures in the combustor R-1 will typically be about 5400°–5600° F.

The operating pressure for the multi-zone reactor R is preferably above about 70 psia and lower than approximately 1000 psia. For the North Slope long residual oil feed, 80 psia was found to be an optimum pressure for both ethylene yield and equipment costs in the recovery section of the process. If it is desired to decrease the yield of acetylene, operating pressures of 250 psia to 1000 psia (preferably 600 to 1000 psia) are recommended.

Since the present process uses heavy hydrocarbon fuels, extreme care must be taken to prevent carbon or coke formation. One of the techniques to minimize coke formation in the present process is to control the flow patterns so that the fuel being injected into R-1 is prevented from impinging upon the walls of the combustion chamber and the fuel stream is prevented from being transported to the walls by adverse gas flow conditions. The contact of hydrocarbon materials with the walls of the combustor result in some production of coke deposits and/or soot. Since the present process must operate for long periods of time with minimum maintenance, the use of inert gas film in the combustor section R-1 is highly desirable. Therefore, the use of a gaseous inert film 5 such as $CO_2$ or $N_5$ along the inner walls of the combustion chamber R-1 will minimize the potential of producing undesired carbon deposits in the combustor.

The fuel stream 1 is delivered from a variable speed pump (not shown) remotely located from the combustion section for safety purposes and at pressures compatible with the nozzle requirements of the oxygen stream. For example, it has been found that approximately a 100 psi increment over the chamber pressure is desirable when using a diesel No. 2 fuel with oxygen. The oxygen stream 2 should be introduced into the combustor R-1 without a swirl component. It is believed that impinging jet flow patterns injected radially into the combustor chamber R-1 are more predictable than swirling flow patterns; therefore, it is easier to develop the desired flow patterns and to maintain them as desired when there is no swirl.

The combustion chamber volume can be sized using rocket engine design criteria. For example, typical rocket engine stay times are between 2 and 40 milliseconds. The preferred stay time in the combustion chamber R-1 is approximately 10 milliseconds based upon a maximum exit velocity of about 171 feet/second. The length of the combustion chamber for this stage is about three times the diameter of the chamber. A well defined temperature profile is achieved across the exit of the combustor R-1 so as to optimize the reactions which must take place in the adjacent reactor section R-2.

The combustion gases from section R-1 of the multizone reactor R then pass into the reactor section R-2. The reactor section comprises feed injectors, a system for inert gas filming and the length of reaction chamber required to obtain the desired diacritic cracking. The optimum residence time in the reaction chamber for the feeds contemplated is less than 10 milliseconds and generally in the 3 to 5 milliseconds range.

The feed stream 4 is supplied from a feed storage tank C and heated by a feed heater $C_1$ by low pressure steam in substantially the same manner that the fuel and $O_2$ streams are heated.

In the presently preferred process, the feeds are heavy hydrocarbon feeds, such as residual oils, crude oils, vacuum gas oils, atmospheric gas oil, coal derived liquids, heavier grades of petroleum oil, such as No. 6 oil, and mixtures thereof. Specific feedstocks which the present process can handle and which are economical to use are North Slope long residuals, residual oils from Indonesia and light Arabian and California crude oils. Also, crudes from North Slope, Indonesia and California, or fractions including vacuum gas oils or atmospheric gas oils, can also be used. The heavier oils sometimes require a recirculating system and steam tracing to keep the supply lines hot enough to handle the heavy oil.

It has been found that as long as the feeds are preheated to obtain about 100 S.S.U., fine atomization, for injection purposes, will be obtained. The temperature for crude oil feeds prior to injection vary between 100° F. to 600° F. depending upon how much of the volatile crude oil fractions have been previously removed prior to their use as a feed. For residual oils and vacuum gas oils, temperatures of about 500° F. to 700° F. are normaly required. Atmospheric gas oils are heated to a temperature within the same range discussed above for crude oils.

The heated feed is introduced into the reaction chamber or section R-2 of the multi-stage reactor R in droplets having a size of about 40 to 100 microns. This can be achieved using conventional atomizers in which steam or other vapors or gases under pressure are used. The operating pressure of the atomizers or nozzles for injecting the above-mentioned type of feed stocks is usually approximately 300 psi above the reactor chamber pressure. The latter pressure parameter allows for good atomization and minimum pump requirements, provided that the liquid fuels have a viscosity of approximately 100 S.S.U. or less.

One of the main aspects of the present invention is the control of conditions in the reactor R-2 which results in the necessary diacritic cracking of the feed stock to produce high yields of ethylene. The reaction which occurs can best be described as "diacritic cracking" which involves a set of reaction conditions resulting in extremely high selectivity to form ethylene by thermal cracking techniques. The term diacritic cracking has been used to distinguish what occurs under the conditions of the present process from adiabatic cracking. The reactions in the chamber R-2 are controlled to favor the so-called forward reaction to crack and form ethylene while repressing back reactions, polymerization and the further decomposition of ethylene to acetylene. Applying kinematic equations to ethylene cracking, one is led to the erroneous conclusion that high pressure must lead to low ethylene production. For example, the ratio of the rates of ethylene formation and polymerization is constant as a function of temperature at constant pressure and increasingly favors polymerization as the pressure is increased:

$$\frac{\text{Rate of Ethylene Formation}}{\text{Rate of Polymerization}} = \text{constant} \cdot \frac{\text{Feed Concentration}}{\text{Ethylene concentration squared}} \cdot \frac{1}{p} \text{ (independent of } T\text{)}$$

The formation of acetylene is favored by increasing temperature:

$$\log \frac{\text{Rate of Ethylene Formation}}{\text{Rate of Acetylene Formation}} = \text{constant} \frac{1}{T} + \log \frac{\text{Feed Concentration}}{\text{Ethylene Concentration}} + \text{Constant}$$

The inventors reasoned that high pressure cracking could be carried out to make the ethylene formation reaction take place at a high temperature and make the adverse polymerization and acetylene formation reaction take place at a lower temperature. The conditions for this to occur are: pressure — 4.5 atmospheres or higher to make the mixing occur rapidly, flow — in the turbulent region all of cracking feed is at the same initial temperature and concentration; and, temperature — high initial temperature for very rapid cracking. Introduction of a diluent (such as steam) reduces the cracking temperature and reduces or eliminates the diacritic reaction effect.

The endothermic cracking reaction causes the temperature to drop at a rapid rate compared to the polymerization and acetylene reaction rates. Once the cracking is completed, the gas streams should be quenched.

Applying these conditions, the reaction to form ethylene should be independent of pressure at pressures higher than the critical pressure (about 4.5 atmospheres) to insure rapid mixing. At turbulent flow conditions, the flow will not change characteristics with pressure; the Mach Number can be made the same; the ratio of specific heats are the same; the Reynolds Number increases with pressure merely increasing turbulence; and the Prandtel Number will not change with a low thermal gradient within the gas stream.

The cracking feed concentration and density of hot gased providing energy for the endothermic reaction remain in the same ratio with pressure. In prior tests which were conducted using naphtha, the product ethylene changed with pressure with a pressure exponent of − 0.18 (between 3 and 10 atmospheres) and the product acetylene with a pressure exponent of − 0.86. This means that increased pressure causes a slight decrease in ethylene, possibly due to polymerization reactions. The decrease of acetylene at higher pressures may be due to decreased formation, or to polymerization reactions. The yield of ethylene was much higher than the yield reported for similar low pressure cracking (e.g., about 50% vs. about 33%).

The extremely small pressure dependence follows from the proposed temperature conditions. The ratio of rates (not considering concentrations) for ethylene-to-polymerization vary with temperature as follows:

| Relative Rates | Cracking Polymerization | | |
|---|---|---|---|
| | 1 atm | 10 atm | 50 atm |
| 1. Cracking and Polymerization Temperatures - 2500° F.: | 1 | .1 | .02 |
| 2. Cracking Temperature - 2500° F. and Polymerization Temperature - 2000° F.: | 39 | 3.9 | .8 |

The above data show that while pressure does increase the rate of polymerization (rapidly with a pressure exponent of 1), the lower polymerization temperature decreases the polymerization rate. The temperature difference of 500° F. shown above is a conservative estimate of the temperature drop caused by the endothermic reaction.

This data explains the low observed pressure dependence for product ethylene. The rate of formation of acetylene is decreased by a factor of 150 between 2500° F. and 2000° F. Thus, the present process involving the above-described reaction at high pressure (e.g., above 4.5 atmospheres) and the use of heavy feeds for high ethylene production is different in approach from the prior art processes which are usually defined as steam-cracking, low pressure combustion product cracking, arc processes and flame-cracking.

To obtain the desired mass flow requirement in the reaction chamber R-2, the number of atomizers is chosen to allow maximum spray coverage with maximum penetration of the combustion gas stream. The reaction chamber is sized to have a reference velocity of about 250 to 350 feet per second. The latter velocity is a deviation from other prior art approaches which have taught the use of sonic nozzles at the point of the feed injection. The present process results in better overall control of the mixing and cracking residence time.

The material for the reactor R-2 is selected to offer long life and yet be easily replaced. The chamber walls are refractory lined (e.g., Purocast alumina refractory and M-26 insulating block manufactured by Kaiser Refractories of Oakland, Calif.) to minimize carbon deposits and to reduce heat transfer through the reactor walls.

As indicated previously, the feed is preferably injected into the reactor chamber R-2 without any swirl. While the gas velocity and heat transfer type wall construction used should minimize coking problems, in order to insure continuous use and low cost maintenance, a gas film 5' of inert $CO_2$ or $N_2$ is again introduced along the walls just downstream from the feed injectors. Such an inert gas could also be used to shroud the injector nozzles as well. The inert gas film may be introduced with or without a swirl component.

The proper high flow conditions in the reaction chamber R-2 must be established and maintained in order to minimize recirculation streams back upstream. Thus, plug flow conditions must be maintained through the reaction chamber R-2. The flow is maintained so than an even flow profile is maintained except for about 1% to 3% of the volume which is present as a boundary layer.

It is desirable for the reactor to utilize feed injectors which are physically located in the combustion system cooling jacket. This is done to minimize internal coking of the injectors. Nitrogen purging should be used on start-up and shut-down to minimize internal coking.

In the reactor section R-1, diacritic cracking takes place by a free radical mechanism. Molecules react with free radicals (H°, $CH_3$°) to form large free radicals from the molecules by abstracting a hydrogen atom (paraffins and napthenes) or by adding a radical (aromatic rings). The large saturated radicals split into ethylene molecules rapidly and the last fragment is a radical which reacts with a new, large molecule. To explain the kinematics of cracking, which is of the first-order, the reactions among molecules are assigned activation energies, combining to give the observed overall activation energy. The radical decomposition reactions are chain reactions since they are initiated by a radical and produce a new radical after the large molecule decomposes. The reactions between the two radicals' terminating chains play an important role in the kinetics, and thus the products formed. For example, the reaction between a hydrogen atom and a $C_8$ radical from a partially decomposed large molecule produces a $C_8$ compound instead of four ethylene molecules. A large concentration of radicals also causes rapid decomposition of the feed compared to a small concentration of radicals, at the same temperature.

The product ethylene is reactive, more reactive than the feed, and tends to react with itself and other olefins by free radical and molecular mechanisms to form larger molecules again (polymerization). Ethylene also reacts by a free radical mechanism to form acetylene. Ethylene produced at high temperatures must be removed from the reaction zone before it can react further. In observing the mechanism of ethylene formation, the inventors were led to define and establish the ideal conditions for the reaction in the invented method for achieving these conditions. For example, the cracking temperature must be high in order to make the rate of ethylene formation high compared to the polymerization reaction rates. The temperature, however, cannot be too high because of the reaction of ethylene to acetylene which becomes important at temperatures above 2500° F. The reaction pressure must be above atmospheric (preferably from 70 psia to 1,000 psia) in order to make initiation reactions efficient. There is an optimum operating pressure for each feed because, at high pressure, the polymerization reactions become more important and the formation of acetylene is suppressed at high pressure. Also, depending on the desired product yields (e.g. acetylene vs. no acetylene) the optimum operating pressures may vary. It has been found that the overall economics (including compressing equipment costs) usually favor operating pressures lower than about 200–300 psia. However, where it is necessary to minimize the amount of acetylene made pressure in the range of about 600–1000 psia are preferable and the economics of higher ethylene yield will justify other increased capital costs. An operating pressure of about 80 psia has been found to yield attractive quantities of ethylene, other $C_2$'s and light olefins. The latter pressure yields substantial amounts of acetylene which can be recovered or hydrogenated to ethylene. The reaction time for the invented process must be short (about 3 to 5 milliseconds and not more than about 10 milliseconds) to prevent the ethylene from reacting further.

The flow rate through the reactor must be kept high and must have an even flow profile to prevent recirculation of the products back into the reaction zone. Therefore, plug flow conditions should be maintained. The feed must be vaporized rapidly and uniformly to insure uniform reaction times. The endothermic nature of the reaction causes a drop of about 500° F. which helps to control the cracking process. Finally, the quench must be rapid and efficient to further control the reaction time. Thus, critical control of flow, temperature, time and pressure are of great importance in establishing the optimum conditions for producing ethylene from the feed stock.

Once the products of the cracking reaction are completed in section R-2, the gaseous product stream passes to the quench section R-3 of the multi-zone reactor R. The quench is accomplished by injecting a suitable hydrocarbon liquid ($C_6$ or higher) into the reactor to precisely control the reaction time of the cracking process. The quench section is very similar in construction to the reactor section R-2. The primary difference is that the quench injectors are located in a higher temperature environment than are the feed injectors. As with the reactor injectors, a nitrogen purge is used on start-up and shut-down to prevent internal coking. The temperature of the products after the injection of the feed is 2400° F. and after the cracking reaction and injection of the quench, the gaseous products are cooled to approximately 1600° F. to 1800° F. In general, the length of the quench chamber R-3 is shorter than that of the reaction chamber R-2. Also, the quench chamber must have flow conditions which prevent recirculation back upstream and thus plug flow conditions must be maintained throughout the quench section R-3.

The hydrocarbon liquid 16' used as the quench medium is preferably a portion of the liquid hydrocarbon stream obtained from the quench oil cooler $Q_2$ which is located downstream and will be discussed in further detail hereinafter. However, any other convenient supply of suitable hydrocarbon fluid which can be used for quenching purposes can be utilized. The gaseous product stream 6 after the quench in R-3 has a temperature of approximately 1600° F. At this point, it is highly desirable to utilize an optional first stage heat exchanger $X_1$ in order to lower the temperature of the gases prior to having such gases diverted to various separating units and to recover heat in form of high pressure steam to partially off-set part of the fuel cost required for the combustion portion of the process. Also, lowering the gaseous product temperature at this point allows the pressure to be more easily regulated for optimum system operating purposes. Thus, a back pressure regulating valve V downstream can be used for maintaining the system operating pressure.

The first stage heat exchanger $X_1$ presents the most difficult problem with respect to the problem of possible coking, especially with the heavy feed stocks used in the present process. The first stage heat exchanger $X_1$ involves a simple tube and shell exchanger in which the product gases are cooled from approximately 1600° F. to approximately 900° F. At about 900° F. the cracking reaction should be totally quenched and further condensation of the products should be minimal. The output 3' from the water jacket of the combustor section R-1 can be used as the heat exchange fluid for $X_1$. In order to minimize coking, the first stage heat exchanger $X_1$, contains a heat shield which protrudes into each cooling tube. Under such shield is another shield which acts as a flow directional guide to feed recycled inert gases, such as $CO_2$ or $N_2$ along the walls of each tube. Such inert gases 5" can be used with or without a swirl component as conditions dictate. The inert gas can be introduced through a plurality of slots spaced down each tube to insure a constant film along the wall of the tube. The gas filming of the tube minimizes direct contact of the condensing fractions with the wall of the tubes of the first stage exchanger and thereby minimize coking at this stage of the process. One of the economic advantages of having a first stage heat exchanger at this stage of the process is to produce high pressure steam (e.g., 1200 psia at 567° F. which can be used for purposes of driving the turbine of the compressors W downstream and/or such high pressure steam can be exported for other purposes).

After the product stream 6' leaves the first stage heat exchanger $X_1$ it enters into a conventional quench oil knock out pot $Q_1$ where the temperature is dropped from 900° F. to about 600° F. At this stage, the gaseous product stream 6" is sent to a second stage heat exchanger while a condensed hydrocarbon stream 16 ($C_6$ or higher) is recovered and sent to a conventional quench oil cooler $Q_2$ which also includes a water jacket into which the water stream 3' from the combustor R-1 can be fed to produce low pressure steam for use in various stages of the present process. The condensed and cooled hydrocarbon stream 16' is recycled for use as the hydrocarbon quenching fluid in section R-3 of the multi-zone reactor and a portion of the hydrocarbon stream is added to the gaseous product stream 9 out of the second stage heat exchanger $X_2$.

The second stage heat exchanger $X_2$ is a high efficiency plate and fin type exchanger and cools the process stream from a temperature of 600° F. to approximately 300° to 350° F. Both the first stage heat exchanger and second stage heat exchanger are operated at elevated pressure on the product gas side thus providing a smaller system then if atmospheric pressure were used. This is possible since the pressure control valve V is located in the cooler gas stream downstream of the second stage heat exchanger. The water stream 7 into the second stage heat exchanger $X_2$ exits as stream 7' which can be recycled and used as part of water stream 3 into combustor section R-1 of the multi-zone reactor R. The gaseous product stream 9 leaves the second heat exchanger $X_2$ at a temperature of about 300° to 350° F. and is ready for conventional product recovery processing. The cooled reaction products 9 are separated in a product recovery section, using conventional and well known chemical engineering unit operations, into various streams which can be recovered as products or recycled in the process as required.

For purposes of illustration, a brief explanation will be made as to the type of chemical unit operations which would normally be involved in order to obtain the various desired by-products including a high yield of the product ethylene. It should be understood that the recovery section shown and described in FIG. 1*b* is merely exemplary as to the steps and their sequence which can be utilized to obtain the desired yield of products. However, the product stream 9 could be processed in different but conventional ways and in a different sequence to obtain substantially the same overall results and yields.

The product stream 9 is sent to a main fractionator F in which a hydrocarbon stream 11 is condensed, taken off the bottom and sent to a gasoline fuel oil splitter S where a stream of gasoline 12 and stream of fuel oil (e.g. diesel oil) 13 is obtained. The gasoline 12 is removed as a valuable product. The fuel oil stream 13 is preferably recycled to the fuel storage tank A for use in the combustion process.

The gaseous product stream is then sent into a conventional acid gas removal unit G (e.g. MEA treatment with a caustic wash) to remove $CO_2$ and stream 14 leaving the acid gas removal unit G is sent through conventional compressors W (the turbines of which can be driven by the high pressure steam 8 obtained from the first stage heat exchanger $X_1$) and the compressed process stream 14' at a pressure of about 140 psia is preferably sent into a lean oil absorption unit L where Co, $H_2$, $N_2$ and chemical grade synthesis gas can be removed and recovered.

In the alternative, the stream 14' leaving the compressor stages W can be sent to a refrigeration or cryogenic recovery processor for removal of CO, $H_2$, $N_2$ and chemical grade synthesis gas. If a refrigeration recovery processor is used, the output stream 14'' is then processed in a different sequence of steps, but the same product streams and substantially the same yields are obtained. Since lean oil absorption is preferred because of reduced capital and operating costs the preferred process uses lean oil absorption and not cryogenic purification.

In the lean oil absorption unit L the CO, $H_2$, $N_2$ and chemical grade synthesis gas are removed and the product stream 15 is sent to the dehydrator D for the removal of water vapor.

From this point of the process to the end, normal distillation and condensation steps are employed to obtain ethylene and the other products. The product stream 18 from the dehydrator D is sent to a demanthanizer M where methane 19 is recovered. The product stream 20 out of the demethanizer M is sent to a deethanizer E where a gaseous ethane stream 21 is recovered. From an economics standpoint the ethane stream 21 can be recycled with the feed stream 4 from the feed heater $C_1$ for injection into reactor chamber R-2.

At this stage of the process a stream 22 is processed through a propylene removal unit R to remove propylene 23 as a product and another heavier hydrocarbon stream 24 from unit R is sent to a $C_4$ and $C_5$ recovery unit H to obtain butadiene 25 and other $C_4$'s and $C_5$'s hydrocarbons as stream 26. The exit stream 27 from the $C_4$ and $C_5$ recovery unit H is sent to a BTX recovery unit I in which a benzene stream 28, toluene stream 29 and a xylene stream 30 are obtained. The exit stream 31 from the BTX recovery unit I is a heavy liquid hydrocarbon stream which can be recycled and used as part of the fuel-makeup.

The last stream 32 from the deethanizer is sent to a conventional acetylene removal unit J (e.g. ammonia solution absorbent) where an acetylene stream 33 can be removed. The product stream 34 leaving the acetylene removal unit J is then sent to $C_2$ splitter and processed to obtain ethylene 35.

If acetylene is not desired and a higher yield of ethylene is required, the product stream 32 from the ethanizer E can be sent to a hydrogenator N where the acetylene molecules are hydrogenated (e.g. using the $H_2$ obtained from the lean oil absorption.) to additional ethylene 35' and combined with the product ethylene stream 35.

The following are yield projections obtainable utilizing the above-described diacritic cracking on a North Slope long residual oil. Table 1 shows the yield distribution for a single pass.

TABLE 1

| COMBUSTION GASES | lbs/lb Feed |
|---|---|
| Water | 0.2380 |
| Carbon Monoxide | 0.2705 |
| Carbon Dioxide | 0.4649 |
| Nitrogen | 0 |

FEED: NORTH SLOPE LONG RESIDUAL OIL (+600° F.)
SINGLE PASS

| PRODUCTS lbs/lb Feed | | | | |
|---|---|---|---|---|
| Pressure, psia | 80 | 150 | 300 | 600 |
| Hydrogen | .030 | .024 | .020 | .015 |
| Hydrogen Sulfide | .005 | .005 | .005 | .005 |
| Methane | .050 | .047 | .044 | .041 |
| Acetylene | .163 | .100 | .050 | .014 |
| Ethylene | .320 | .313 | .307 | .300 |
| Ethane | .019 | .081 | .130 | .165 |
| Propylene | .057 | .050 | .041 | .033 |
| Butadiene | .030 | .027 | .024 | .020 |
| $C_4$'s (other) | .007 | .005 | .004 | .003 |
| $C_5$'s | .010 | .010 | .011 | .011 |
| BTX | .075 | .070 | .065 | .060 |
| Benzene | .060 | .055 | .050 | .045 |
| Tolnene | .014 | .014 | .014 | .014 |
| Xylene | .001 | .001 | .001 | .001 |
| Gasoline Boiling Range | .065 | .077 | .092 | .103 |
| High Boiling Products | .169 | .191 | .207 | .230 |

Table 2 shows the yield distribution of the invented process with the recycling of ethane as part of the feed stream.

TABLE 2

FEED: NORTH SLOPE LONG RESIDUAL OIL (+600° F.)
RECYCLE: ETHANE

| PRODUCTS lbs/lb Feed* | | | | |
|---|---|---|---|---|
| Pressure, psia | 80 | 150 | 300 | 600 |
| Hydrogen | .031 | .031 | .031 | .029 |
| Hydrogen Sulfide | .005 | .005 | .005 | .005 |
| Methane | .050 | .047 | .044 | .041 |
| Acetylene | .163 | .100 | .050 | .014 |
| Ethylene | .335 | .373 | .405 | .421 |
| Ethane | — | — | — | — |
| Propylene | .057 | .050 | .041 | .033 |
| Butadiene | .030 | .027 | .024 | .020 |
| $C_4$'s (other) | .007 | .005 | .004 | .003 |
| $C_5$'s | .010 | .010 | .011 | .011 |
| BTX | .075 | .070 | .065 | .060 |
| Gasoline Boiling Range | .065 | .077 | .092 | .103 |
| High Boiling Products | .172 | .205 | .228 | .260 |

*(Does not include recycle)

Table 3 shows the yield distribution of invented process as shown in Table 1 with the ethane recycled as a feed and the acetylene stream hydrogenated to ethylene.

TABLE 3

FEED: NORTH SLOPE LONG RESIDUAL OIL (+600° F.)
RECYCLE: ETHANE
HYDROGENATE ACETYLENE TO ETHYLENE

| | PRODUCTS lbs/lb Feed* | | | |
|---|---|---|---|---|
| Pressure, psia | 80 | 150 | 300 | 600 |
| Hydrogen | .021 | .024 | .027 | .028 |
| Hydrogen Sulfide | .005 | .005 | .005 | .005 |
| Methane | .050 | .047 | .044 | .041 |
| Acetylene | — | — | — | — |
| Ethylene | .508 | .480 | .459 | .436 |
| Ethane | — | — | — | — |
| Propylene | .057 | .050 | .041 | .033 |
| Butadiene | .030 | .027 | .024 | .020 |
| $C_4$'s (other) | .007 | .005 | .004 | .003 |
| $C_5$'s | .010 | .010 | .011 | .011 |
| BTX | .075 | .070 | .065 | .060 |
| Gasoline Boiling Range | .065 | .077 | .092 | .103 |
| High Boiling Products | .172 | .205 | .228 | .260 |

*(Does not include recycle)

Table 4 shows the yield distribution of the invented process as shown in Table 1 with the ethane, $C_4$, $C_5$ and gasoline boiling product streams recycled as feed and the acetylene stream hydrogenated to ethylene.

TABLE 4

FEED: NORTH SLOPE LONG RESIDUAL OIL (+600° F.)
RECYCLE: ETHANE, $C_4$'s, $C_5$'s & GASOLINE BOILING PRODUCTS;
HYDROGENATE ACETYLENE TO ETHYLENE

| | PRODUCTS lbs/lb Feed* | | | |
|---|---|---|---|---|
| Pressure, psia | 80 | 150 | 300 | 600 |
| Hydrogen | .026 | .030 | .034 | .036 |
| Hydrogen Sulfide | .005 | .005 | .005 | .005 |
| Methane | .056 | .054 | .051 | .049 |
| Acetylene | — | — | — | — |
| Ethylene | .550 | .527 | .513 | .495 |
| Ethane | — | — | — | — |
| Propylene | .063 | .057 | .049 | .043 |
| Butadiene | .032 | .029 | .027 | .024 |
| $C_4$'s (other) | — | — | — | — |
| $C_5$'s | — | — | — | — |
| BTX | .075 | .070 | .065 | .060 |
| Gasoline Boiling Range | — | — | — | — |
| High Boiling Products | .193 | .228 | .255 | .288 |

*(Does not include recycle)

Table 5 shows the yield distribution of the invented process for North Slope Crude Oil with no recycle.

TABLE 5

FEED: NORTH SLOPE CRUDE OIL (+600° F.)
RECYCLE: NONE

| | PRODUCTS lbs/lb Feed* |
|---|---|
| Pressure, psia | 80 |
| Hydrogen (.022 from feed) | .039 |
| Hydrogen Sulfide | .004 |
| Methane | .059 |
| Acetylene | .137 |
| Ethylene | .379 |
| Ethane | .026 |
| Propylene | .062 |
| Butadiene | .021 |
| $C_4$'s (other) | .009 |
| $C_5$'s | .011 |
| BTX | .071 |
| Gasoline Boiling Range | .059 |
| High Boiling Products | .140 |

Table 6 shows the yield distribution of the invented process for a typical residual oil which has been derived from hydrogen treated coal.

TABLE 6

FEED: COAL DERIVED RESIDUAL OIL (+600° F.)
RECYCLE: NONE

| | PRODUCTS lbs/lb Feed* |
|---|---|
| Pressure, psia | 80 |
| Hydrogen | .005 |
| Hydrogen Sulfide | .002 |
| Methane | .050 |
| Acetylene | .040 |
| Ethylene | .200 |
| Ethane | .005 |
| Propylene | .042 |
| Butadiene | .010 |
| $C_4$'s (other) | .010 |
| $C_5$'s | .010 |
| BTX | .090 |
| Gasoline Boiling Range | .050 |
| High Boiling Products | .486 |

Based upon the above data and the overall economic considerations (including equipment costs) with respect to operating at various elevated pressures, the invented process for North Slope long residual oil should be preferably operated at pressures of approximately 70 to 100 psia. As can be seen from Table 1 through 6 above, excellent yields were obtained for ethylene and the other valuable by-products at a reactor pressure of 80 psia. Also, Table 5 and 6 show that excellent yields can also be obtained at 80 psia for North Slope crude oil and coal derived residual oil.

The invented process involves a number of instrument and control aspects in order to insure continuous, efficient and safe start-up and operation. For example, the primary control of the process is on the fuel flow to the combustor. Variations in this flow will affect product yield.

The mass flow, fuel, feed, quench and oxygen streams are sensed by flow-meters. Regulation of the fuel flow rate will be based upon the excess oxygen, carbon dioxide and carbon monoxide-measured values at the discharge plane of the combustor chamber R-1. Additional regulation will be made by use of a gas chromatograph and discharge valve pressure. The controls will provide modulation of the fuel being supplied to the combustion chamber R-1.

Start up of the system requires a purge sequence prior to pilot ignition. Simultaneously, a purge is initiated to the feed and quench injectors to assure that all previous feed or oil has been removed from the nozzles. Once the purge is complete, a light off the combustor is made by first initiating oxygen flow and then adding the fuel flow. The system is brought up to a low mass flow and pressure setting, and at a mixture ratio that results in an effective reactor temperature with full operating conditions. This temperature is approximately 2400° in the reactor. A soak period of about one-half hour allows the hardware temperatures to stabilize, probably in the order of a half-hour.

After the soak period, the mass flows are increased to achieve near operating pressure levels. Once this condition is achieved, the feed and quench are initiated and followed by an increase in the combustion fuel flow. This sequence is programmed so that the rates are increased proportionately; otherwise, the reactor walls could be over-heated by the temperatures which could be generated by the combustor. Cooling water flow rates are also programmed to allow for a smooth trasition to steady state.

The combustor has an infrared flame detection system which terminates all flow systems in an event of flame failure in the combustor. The prime control is on the combustor system; all other controls are secondary in relationship to the operation of the burner.

Although the present invention has been described in considerable detail with reference to certain preferred process steps and equipment, it will be understood that certain modifications can be effected by those skilled in the art without departing from the scope of the invention as described hereinabove and as defined in the appended claims.

We claim:

1. A method for the diacritic cracking of hydrocarbon feedstocks to obtain high yields of ethylene at a pressure in the range of about 70 psia to 1,000 psia comprising the steps of:

(a) feeding into a first zone of a reactor a hydrocarbon containing fuel stream and combusting said fuel in the presence of oxygen to form gaseous combustion products having a temperature sufficient to crack a preselected hydrocarbon feedstock;

(b) passing said combustion products into a second zone of said reactor in which sad preselected hydrocarbon feedstock is injected into said combustion products causing said hydrocarbon feed stock to react and be diacritically cracked so as to selectively form a gaseous product stream comprising a substantial yield of gaseous ethylene, synthesis gas, and said combustion products, said hydrocarbon feedstock being in said second zone for a residence time period of about 3 to 10 milliseconds and at a temperature of about 2400° to 2500° F. to allow said selective diacritic cracking to occur;

(c) passing into said second zone of said reactor an inert gas to form a gas film primarily along the wall surfaces of said reactor to minimize the deposit of coke in said second zone, said coke having been formed by the combustion of the hydrocarbon fuel in said first zone and by the cracking of the hydrocarbon feedstock in said second zone; and (d) cooling said gaseous product stream from said second zone in a third zone of said reactor to terminate further cracking and reactions, thereby optimizing the yield of ethylene.

2. The method of claim 1 which said feedstocks are heavy hydrocarbon feedstocks selected from the group consisting of crude oils, residual oils, vacuum gas oils, atomspheric gas oils, heavy grades of petroleum oils, coal derived liquids and mixtures thereof.

3. The method of claim 2 in which said heavy hydrocarbon feedstocks are atomized into droplets having a size of about 40 to 100 microns for injection into said combustion products.

4. The method of claim 3 in which said heavy feedstocks are heated prior to injection to have a viscosity not in excess of approximately 100 S.S.U.

5. The method of claim 1 in which said gaseous combustion products and said gaseous product stream are caused to flow through said reactor under plug flow conditions to prevent recirculation flow patterns back through said reactor.

6. The method of claim 1 in which the flow of said gaseous combustion products and said gaseous product stream through said second zone is at a reference velocity of about 250 to 350 feet per second.

7. The method of claim 1 in which said inert gas is $CO_2$ or $N_2$.

8. The method of claim 7 in which an inert gas stream is also injected simultaneously with said feedstock into said second zone.

9. The method of claim 1 in which said oxygen to fuel ratio is in the rage of 2:1 to 3:1.

10. The method of claim 1 in which said residence time in second zone is between about 3 to 5 milliseconds.

11. The method of claim 9 in which said oxygen to fuel ratio is in the range of 2.5:1.

12. The method of claim 2 in which said pressure is 80 psia.

13. The method of claim 2 in which said hydrocarbon fuel is comprised in part of a fuel selected from the group consisting of crude oil, diesel fuels, residual oils, recycled hydrocarbons recovered from the cracking step and mixtures thereof.

14. The method of claim 1 in which said fuel is introduced into said first zone in flow patterns which tend to prevent said fuel from impinging upon and being transported to the walls of said reactor in order to minimize the deposit of coke in said first zone.

15. The method of claim 1 in which a gaseous inert film is introduced along the walls of said first zone of said reactor to minimize the deposit of coke formed during the combustion of the fuel.

16. The method of claim 1 in which said gaseous product stream is cooled to about 1600° F. to 1800° F. in the third zone of said reactor.

17. The method of claim 16 in which said cooling step is accomplished by injecting a cooler hydrocarbon liquid into said third zone.

18. The method of claim 1 in which gaseous stream leaving the third zone of said reactor is further cooled in a tubular jacketed heat exchanger to a temperature of about 900° F.

19. The method of claim 18 in which an inert gas film is introduced at a plurality of points along the interior walls of the tubular heat exchanger, thereby minimizing coke deposits in said heat exchanger by minimizing contact of the condensity fractions of the gaseous stream being cooled with the walls of the heat exchanger.

20. The method of claim 19 in which water is used as the heat exchange medium into the heat exchanger jacket and high pressure steam of about 1200 psia is produced at the output of said heat exchanger jacket.

21. The method of claim 16 in which said gaseous product stream is cooled, to about 300° F. to 350° F., compressed and passed into a lean oil absorber to recover chemical grade synthesis gas.

22. The method of claim 16 in which said gaseous product stream is cooled to about 300° F. to 350° F., compressed and passed through a cryogenic recovery process to recover chemical grade synthesis gas.

23. The method of claim 16 in which said produce stream is cooled, compressed and passed through a plurality of produce recovery stages to obtain by distillation and condensation said ethylene.

24. The method of claim 23 in which methane, ethane, acetylene, propylene, butadiene, benzene, toluene, xylene, gasoline and fuel oil are obtained as by-products by fractionation, distillation and condensation steps.

25. The method of claim 24 in which acetylene is hydrogenated to ethylene to obtain an increased yield of ethylene.

26. The method of claim 24 in which said ethane is recycled and added to the feedstock.

27. The method of claim 24 in which said fuel oil is recycled and added to the hydrocarbon fuel stream.

28. A method for the diacritic cracking of heavy hydrocarbon feedstocks selected from the group consisting of crude oils, residual oils, vacuum gas oils, atmospheric gas oils, heavy grades of petroleum oils, coal derived liquids and mixtures thereof, to obtain ethylene, light olefins and synthesis gas at a pressure in the range of about 70 psia to 1,000 psia comprising the steps of:

(a) feeding a liquid hydrocarbon fuel into a first zone of a multi-zone reactor;

(b) feeding an oxygen stream into said first zone;

(c) combusting in said first zone said hydrocarbon fuel and said oxygen to form gaseous combustion products having a temperature sufficient to crack a preselected hydrocarbon feedstock;

(d) passing said combustion products into a second zone of said reactor in which said preselected hydrocarbon feedstock is injected in atomized droplets into said combustion products causing said hydrocarbon feedstock to react and be diacritically cracked so as to selectively form a gaseous product stream comprising a substantial yield of gaseous ethylene, synthesis gas, and said combustion products, said hydrocarbon feedstock being in said second zone for a residence time period of 3 to 10 milliseconds and at a temperature of about 2400° to 2500° F. to allow said diacritic cracking to occur;

(e) passing into said second zone of said reactor an inert gas to form a gas film primarily along the wall surfaces of said reactor to minimize the deposit of coke on said wall surfaces in said second zone, said coke having been formed by the combustion of the hydrocarbon fuel in said first zone and by the cracking of the feedstock in said second zone; and (d) promptly cooling said gaseous product stream from said second zone in a third zone of said multistage reactor to terminate further cracking and reactions thereby optimizing the yield of ethylene.

29. The method of claim 28 in which said heavy hydrocarbon feedstocks are atomized into droplets having a size of about 40 to 100 microns for injection into said combustion products.

30. The method of claim 29 in which said heavy feedstocks are heated prior to injection to have a viscosity not in excess of approximately 100 S.S.U.

31. The method of claim 28 in which said gaseous combustion products and said gaseous product stream are caused to flow through sid reactor under plug flow conditions to prevent recirculation flow patterns back through said reactor.

32. The method of claim 28 in which the flow if said gaseous combustion products and said gaseous product stream through said second zone is at a reference velocity of about 250 to 350 feet per second.

33. The method of claim 28 in which said inert gas is $CO_2$ or $N_2$.

34. The method of claim 33 in which an inert gas stream is also injected simultaneously with said feedstock in said second zone.

35. The method of claim 28 in which said oxygen to fuel ratio is in the range of 2:1 to 3:1.

36. The method of claim 28 in which said residence time in said second zone is between about 3 to 5 milliseconds.

37. The method of claim 35 in which said oxygen to fuel ratio is in the range of 2.5:1.

38. The method of claim 28 in which said pressure is 80 psia.

39. The method of claim 28 in which said hydrocarbon fuel is comprised in part of a fuel selected from the group consisting of crude oil, diesel fuel, residual oils, recycled hydrocarbons recovered from the cracking step and mixtures thereof.

40. The method of claim 28 in which said fuel is introduced into said first zone in flow patterns which tend to prevent said fuel from impinging upon and being transported to the walls of said reactor in order to minimize the deposit of coke in said first zone.

41. The method of claim 28 in which a gaseous inert film is introduced along the walls of said first zone of said reactor to minimize the deposit of coke formed during the combustion of the fuel.

42. The method of claim 28 in which said heavy hydrocarbon feed is a crude oil or atmospheric gas oil having a temperature of about 100° F. to 600° F.

43. The method of claim 28 in which said hydrocarbon feed is a residual oil or vacuum gas oil having a temperature of about 500° F. to 700° F.

44. The method of claim 28 in which said gaseous product stream is cooled to about 1600° F. to 1800° F. in the third zone of said reactor.

45. The method of claim 44 in which said cooling step is accomplished by injecting a cooler hydrocarbon liquid into said third zone.

46. The method of claim 28 in which said gaseous stream leaving the third zone of said reactor is further cooled in a tubular jacketed heat exchanger to a temperature of about 900° F.

47. The method of claim 46 in which an inert gas film is introduced at a plurality of points along the interior walls of the tubular heat exchanger, thereby minimizing coke deposits in said heat exchanger by minimizing contact of the condensity fractions of the gaseous stream being cooled with the walls of the heat exchanger.

48. The method of claim 47 in which water is used as the heat exchange medium into the heat exchanger jacket and high pressure steam of about 1200 psia is produced at the output of said heat exchanger jacket.

49. The method of claim 44 in which said gaseous product stream is cooled, to about 300° F. to 350° F., compressed and passed into a lean oil absorber to recover chemical grade synthesis gas.

50. The method of claim 44 in which said gaseous product stream is cooled to about 300° F. to 350° F., compressed and passed through a cryogenic recovery process to recover chemical grade synthesis gas.

51. The method of claim 44 in which said product stream is cooled, compressed and passed through a plurality of product recovery stages to obtain by distillation and condensation said ethylene.

52. The method of claim 51 in which methane, ethane, acetylene, propylene, butadiene, benzene, toluene, xylene, gasoline and fuel oils are obtained as by-products by fractionation, distillation and condensation steps.

53. The method of claim 52 in which acetylene is hydrogenated to ethylene to obtain an increased yield of ethylene.

54. The method of claim 52 in which said ethane is recycled and added to the feedstock.

55. The method of claim 52 in which said fuel oil is recycled and added to the hydrocarbon fuel stream.

56. The method of claim 28 in which said pressure is about 600 psia to 1,000 psia.

* * * * *